US009968988B2

(12) United States Patent
Masugata

(10) Patent No.: US 9,968,988 B2
(45) Date of Patent: May 15, 2018

(54) BLIND RIVET FASTENING DEVICE

(71) Applicant: NEWFREY LLC, Newark, DE (US)

(72) Inventor: Hiroyuki Masugata, Toyohashi (JP)

(73) Assignee: NEWFREY LLC, New Britain, CT (US)

( * ) Notice: Subject to any disclaimer, the term of this patent is extended or adjusted under 35 U.S.C. 154(b) by 738 days.

(21) Appl. No.: 14/548,704

(22) Filed: Nov. 20, 2014

(65) Prior Publication Data

US 2015/0074964 A1 Mar. 19, 2015

Related U.S. Application Data

(63) Continuation of application No. PCT/US2013/028573, filed on Mar. 1, 2013.

(30) Foreign Application Priority Data

May 31, 2012 (JP) ..... 2012-124750

(51) Int. Cl.

| | |
|---|---|
| ***B21J 15/10*** | (2006.01) |
| ***B21J 15/26*** | (2006.01) |
| ***B21J 15/04*** | (2006.01) |
| ***B21J 15/32*** | (2006.01) |

(52) U.S. Cl.

CPC ..... *B21J 15/105* (2013.01); *B21J 15/043* (2013.01); *B21J 15/26* (2013.01); *B21J 15/326* (2013.01); *Y10T 29/53752* (2015.01)

(58) Field of Classification Search

CPC ..... B21J 15/26; B21J 15/105; B21J 15/043; B21J 15/326

USPC ..... 29/243.526

See application file for complete search history.

(56) References Cited

U.S. PATENT DOCUMENTS

| | | | | |
|---|---|---|---|---|
| 3,906,775 | A | 9/1975 | Benimetzki | |
| 5,473,805 | A | 12/1995 | Wille | |
| 6,141,849 | A * | 11/2000 | Honsel | B21J 15/26 29/243.521 |
| 8,443,512 | B2 | 5/2013 | Masugata | |
| 9,180,510 | B2 * | 11/2015 | Sugata | B21J 15/26 |

FOREIGN PATENT DOCUMENTS

| | | |
|---|---|---|
| CN | 101579717 | 11/2009 |
| DE | 19812718 | 9/1998 |
| DE | 102007059422 | 6/2009 |

(Continued)

*Primary Examiner* — David B Jones

(74) *Attorney, Agent, or Firm* — Kofi A. Schulterbrandt; Michael P. Leary

(57) ABSTRACT

A blind rivet fastening device in which a passage for collecting broken mandrels is provided other than on the axis of the motor. A large collection chamber is provided for broken mandrels. A collection chamber for broken mandrels is provided in front of a brushless electric motor in the axial direction. When the electric motor rotates, power from the electric motor is transmitted to a spindle positioned to the rear of the collection chamber via a second shaft positioned below the collection chamber. When the spindle rotates, a pulling head moves in the axial direction. The axial position of the pulling head is determined by detecting the rotation count of the electric motor. Forward rotation, reverse rotation, and stopping of the electric motor are controlled based on the operation of a trigger and the axial position of the pulling head. Excessive torque is avoided by clutches.

11 Claims, 7 Drawing Sheets

(56) References Cited

FOREIGN PATENT DOCUMENTS

| | | |
|---|---|---|
| EP | 2246132 | 11/2010 |
| EP | 2374558 | 10/2011 |
| GB | 1457326 | 12/1976 |
| JP | H0471728 | 3/1992 |
| JP | 5200476 | 8/1993 |
| JP | 2001104424 | 4/2001 |
| JP | 2003266143 | 9/2003 |
| JP | 2008168324 | 7/2008 |
| JP | 2011218381 | 11/2011 |
| JP | 2011255483 | 11/2011 |
| JP | 201240629 | 3/2012 |

* cited by examiner

BLIND RIVET FASTENING DEVICE

CROSS-REFERENCE TO RELATED APPLICATIONS

This application is a continuation of PCT/US2013/028573, filed Mar. 1, 2013, which claims priority, under 35 U.S.C. § 119(a)-(d), to JP Patent Application No. 2012-124750 filed May 31, 2012, the contents of which are incorporated herein by reference in its entirety.

BACKGROUND OF THE INVENTION

Field of the Invention

The present invention relates to an electric blind rivet fastening device using an electric motor and, more specifically, to a blind rivet fastening device in which a passage for collecting broken mandrels does not have to be provided on the axis of the motor.

PRIOR ART DOCUMENTS

Laid-Open Patent Publication No. 5-200476 (hereinafter "Patent Document 1")

Laid-Open Patent Publication No. 2003-266143 (hereinafter "Patent Document 2")

Laid-Open Patent Publication No. 2008-168324 (hereinafter "Patent Document 3")

Laid-Open Patent Publication No. 2011-218381 (hereinafter "Patent Document 4")

A blind rivet has a mandrel and a rivet body, and the rivet body has a hollow, cylindrical sleeve, and a large-diameter flange formed on one end of the cylindrical sleeve. The mandrel has a shaft portion which passes through the rivet body, extends beyond the flange, and is gripped by the blind rivet fastening device, and a mandrel head whose diameter is greater than the inner diameter of the cylindrical sleeve positioned so as to protrude from the other end of the cylindrical sleeve. In a blind rivet, the gripped portion of the mandrel shaft is inserted into the nose of the blind rivet fastening device, and the rivet body and the mandrel head are gripped by the blind rivet fastening device so as to protrude from the nose. In the blind rivet gripped by the blind rivet fastening device, the sleeve of the rivet body is inserted into a mounting hole in the members to be fastened (fastened members), and the flange is brought into contact with the surface of a fastened member.

Next, the blind rivet in the blind rivet fastening device is operated, the mandrel shaft is pulled out with force, the mandrel head deforms and widens a portion of the sleeve, the fastened members are strongly interposed between the flange and the deformed portion of the sleeve with a wider diameter, the mandrel shaft breaks off in the breakable portion with a narrow diameter, and the rivet body is fastened to the fastened members. When the fastened members are an automotive body panel and automotive component mounted on the automotive body panel, the automotive component is mounted on the automotive body panel by fastening both members with a blind rivet while the mounted portion of the automotive component is superimposed on the body panel. A blind rivet can be fastened from one side, which is convenient when the automotive body panel or other panel is a large panel covering a wide area. Blind rivets are usually made of a metal such as steel or aluminum. After the fastening operation has been completed, the broken mandrel shaft from the blind rivet has to be collected from the blind rivet fastening device.

Patent Document 1 discloses one type of blind rivet fastening device, which is an electric blind rivet fastening device using a battery-operated electric motor. An electric motor stored inside the handle drives the blind rivet fastening mechanism, and the gripped portion of the mandrel shaft on a blind rivet gripped by the nose is strongly pulled out so the mandrel head deforms and widens a portion of the sleeve, the mandrel shaft breaks off in the small-diameter breakable portion, and the blind rivet is fastened in the fastened members. Unlike a pneumatic or hydraulic blind rivet fastening device, a battery-operated blind rivet fastening device does not require a pressurized fluid supply tube between the handle and a pneumatic or hydraulic pressurized fluid supply source. This lessens the burden on the operator holding the handle, and makes the fastening operation easier.

In the electric blind rivet fastening device disclosed in Patent Document 1, a collection chamber for collecting broken mandrel shafts is arranged to the rear of the blind rivet fastening mechanism. In this blind rivet fastening device, a large electric motor is arranged in the upper portion of the handle. Because this increases the size of the upper portion of the fastening device handle, and because both the electric motor in the upper portion of the handle and the nose portion at the front of the fastening device are heavy, the weight balance of the fastening device is poor. This makes it difficult for the operator to hold the handle and perform the fastening operation comfortably.

Patent Document 2 discloses a blind rivet fastening device using an electric motor. In this device, the blind rivet fastening mechanism, the collection chamber for broken mandrels, and the electric motor between the fastening mechanism and the collection chamber are all arranged coaxially inside a substantially cylindrical housing. In this electric blind rivet fastening device, the electric motor is arranged in the upper portion of the handle at the rear. As a result, the weight balance is better than that of the fastening device in Patent Document 1, and the handle is easier for the operator to hold and perform the fastening operation comfortably.

In the electric blind rivet fastening device of Patent Document 2, the motor is arranged between the blind rivet fastening mechanism and the collection chamber for broken mandrel shafts. As a result, the passage for collecting broken mandrel shafts is formed on the central axis of the motor, forming an air cavity on the central axis of the motor and requiring an electric motor with a special structure. Therefore, an electric blind rivet fastening device is required which can use an all-purpose electric motor and which does not require a recovery passage for broken mandrel shafts along the central axis. Patent Document 3 discloses a hydraulic blind rivet fastening device controlled by a pneumatic control mechanism. This blind rivet fastening device includes a blind rivet fastening mechanism housed inside a cylindrical housing, and a handle extending orthogonally with respect to the cylindrical housing for the fastening mechanism. The collection chamber for broken mandrel shafts is provided at the rear end of the housing for the fastening mechanism. When the trigger provided in the handle is squeezed, the pneumatic control mechanism provided inside the handle is activated, and the hydraulic control mechanism of the blind rivet fastening mechanism is operated. The drawing force on the mandrel shaft of the blind rivet gripped by the nose causes the mandrel head to deform and widen a portion of the sleeve while also causing the small-diameter breakable portion of the mandrel shaft to break. The fastened members are fastened by the blind rivet, and the broken mandrel shaft is collected in the collection chamber.

The blind rivet fastening device in Patent Document 3 has to be connected to a pressurized air source in the handle or to a supply tube for pressurized air. As a result, the operator is burdened by a supply tube. Because a pressurized fluid supply tube is required, the fastening device is not as easy to handle as the electric blind rivet fastening devices in Patent Document 1 and Patent Document 2, and the operator has to drag along a supply tube which complicates the operation.

Patent Document 4 discloses a blind rivet fastening device using an electric motor. The device in Patent Document 4 includes a collection chamber containing broken mandrel shafts in the upper portion of the handle and in front of the electric motor in the axial direction. The electric motor is arranged to the rear of the collection chamber in the axial direction, and a power transmitting means for transmitting the rotation of the electric motor to the pulling head is arranged below the collection chamber in order to bypass the collection chamber. Because the collection chamber for broken mandrels is arranged in front of the electric motor, the passage for collecting broken mandrels does not have to be provided along the central axis of the motor. In the device of Patent Document 4, a power transmitting means is provided which bypasses the collection chamber. A mechanical switch is used to detect the rotation of the drive shaft passing below the collection chamber and to determine the position of the pulling head. However, the mechanical switch takes up space below the collection chamber, so the size of the collection chamber has to be reduced.

Therefore, a compact, battery-powered blind rivet fastening device is desired in which the passage for collecting broken mandrels does not have to be provided along the central axis of the motor. A blind rivet fastening device is also desired in which the collection chamber for collecting broken mandrels can be enlarged.

BRIEF SUMMARY OF THE INVENTION

An object of the present invention is to provide a compact, battery-powered blind rivet fastening device in which a passage for collecting broken mandrels does not have to be provided on the axis of the motor. Another object of the present invention is to provide a blind rivet fastening device able to enlarge the capacity of the collection chamber for collecting broken mandrels. Another object of the present invention is to provide a blind rivet fastening device in which excessive torque can be avoided.

In the present invention, the collection chamber for mandrels is positioned in front of the brushless motor, and a second shaft provided below the collection chamber bypasses the electric motor to transmit the rotation of the electric motor to the pulling head. The position of the pulling head is determined by the rotation of the brushless motor. As a result, a mechanical switch is not required, the capacity of the collection chamber can be increased, and durability can be improved. Also, a clutch is provided to position the pulling head at the home position, and avoid excessive torque.

One aspect of the present invention is a blind rivet fastening device for deforming a sleeve of a rivet body so as to expand diametrically by drawing, in the axial direction, a mandrel of a blind rivet including a mandrel and a rivet body, thereby fastening the rivet body to a mounted member via the expanded sleeve portion and a flange of the rivet body, and breaking the mandrel, the blind rivet fastening device characterized in comprising: an electric motor provided on one end; a power transmitting means for transmitting the rotation of the electric motor; a spindle provided in front of the electric motor and rotated by the power transmitted by the power transmitting means; a ball screw nut adjacent to the spindle, and connected to and rotated by the spindle; a ball screw shaft provided in the central portion of the ball screw nut in the axial direction, and moved in the axial direction by the rotation of the ball screw nut; a drawing means connected to the ball screw shaft for gripping and drawing a shaft portion of the mandrel; a rotation count detecting element for detecting the rotation count of the electric motor; a trigger provided in a handle portion; and a control means for controlling the forward rotation, reverse rotation, and stopping of the electric motor based on operation of the trigger and the rotation count of the electric motor.

In the battery-powered electric blind rivet fastening device of the present invention, the position of the pulling head can be determined by detecting the rotation of the electric motor. As a result, a mechanical switch is not required to determine the position of the pulling head, and the durability can be improved. In this electric blind rivet fastening device, because the collection chamber for broken mandrels is provided in front of the electric motor in the tool housing, a passage for collecting broken mandrels does not have to be provided along the central axis of the motor. The collection chamber for broken mandrels is provided between the electric motor and the spindle, the power can bypass the collecting case during transmission, and the position of the pulling head can be determined by detecting the rotation of the electric motor. As a result, a mechanical switch is not required to determine the position of the pulling head, and the capacity of the collecting case can be increased.

In this blind rivet fastening device, the drawing means can include a pulling head moved in the axial direction by the ball screw shaft moving in the axial direction; a jaw case adjacent to the pulling head, integrated with the pulling head, and having an inner peripheral surface whose inner diameter becomes smaller towards the front end; a jaw provided inside the jaw case, and having an outer peripheral surface in contact with the inner peripheral surface of the jaw case; and a nose piece adjacent to the jaw, and having an opening portion through which passes the shaft portion of the mandrel. In this way, the shaft portion of the mandrel can be reliably gripped and drawn to fasten the blind rivet.

In this blind rivet fastening device, the power transmitting means includes: a motor gear connected to the electric motor; a rear gear provided below the motor gear and engaging the motor gear; a spindle gear engaging the spindle; a front gear provided below the spindle gear and engaging the spindle gear; a second shaft provided below the collection chamber and integrally joined to the rear gear and the front gear. In this way, a second shaft parallel to the shaft of the electric motor can bypass the collection chamber and transmit power from the electric motor to the spindle.

In this blind rivet fastening device, the electric motor can be a brushless motor. The rotation count of a brushless motor can be controlled with greater precision. In this blind rivet fastening device, the rotation count detecting element can be a Hall element. The rotation of the electric motor can be easily detected when a Hall element is included in the brushless motor.

This blind rivet fastening device can comprise a first clutch including: a spindle clutch having a cylindrical portion and a fan-shaped portion, able to move in the axial direction with respect to the spindle, and rotating with the spindle; and a nut clutch having a fan-shaped portion engaging the fan-shaped portion of the spindle clutch, and integrally joined to the ball screw nut; the first clutch able to disengage from the spindle clutch and the nut clutch so as not to transmit the rotation of the spindle to the ball screw nut. This can keep the pulling head from performing excessive drawing.

The protruding portion of a cylindrical tail integrally joined to the rear end of the ball screw shaft may push an inner end face of the spindle clutch to the rear in the axial direction, and the fan-shaped portion of the spindle clutch may disengage from the fan-shaped portion of the nut clutch when the ball screw shaft reaches the rear end in the axial direction.

This blind rivet fastening device can comprise a second clutch including: a rear clutch having a cylindrical shape and saw teeth at the front end, and arranged so as to be able to move in the axial direction around the pulling head but so as not to be able to rotate; and a front clutch having a cylindrical shape and saw teeth at the rear end engaging the saw teeth of the rear clutch, and arranged in front of the rear clutch, around the pulling head, and integrally joined to the pulling head.

The saw teeth of the rear clutch may have one face which is parallel to the rear clutch in the axial direction, and another face inclined with respect to the axial direction; and the saw teeth of the front clutch may have a shape able to engage the saw teeth of the rear clutch.

Alternatively, the ball screw shaft does not move in the axial direction but rotates with the ball screw nut, the front clutch rotates, and the rear clutch retreats in the axial direction so the front clutch is able to rotate when the ball screw shaft reaches the front end.

The present invention provides a compact, battery-powered blind rivet fastening device in which a passage for collecting broken mandrels does not have to be provided on the axis of the motor. The present invention also provides a blind rivet fastening device able to enlarge the capacity of the collection chamber for collecting broken mandrels. In addition, the present invention provides a blind rivet fastening device in which excessive torque can be avoided.

DETAILED DESCRIPTION OF THE INVENTION

Figure 1:
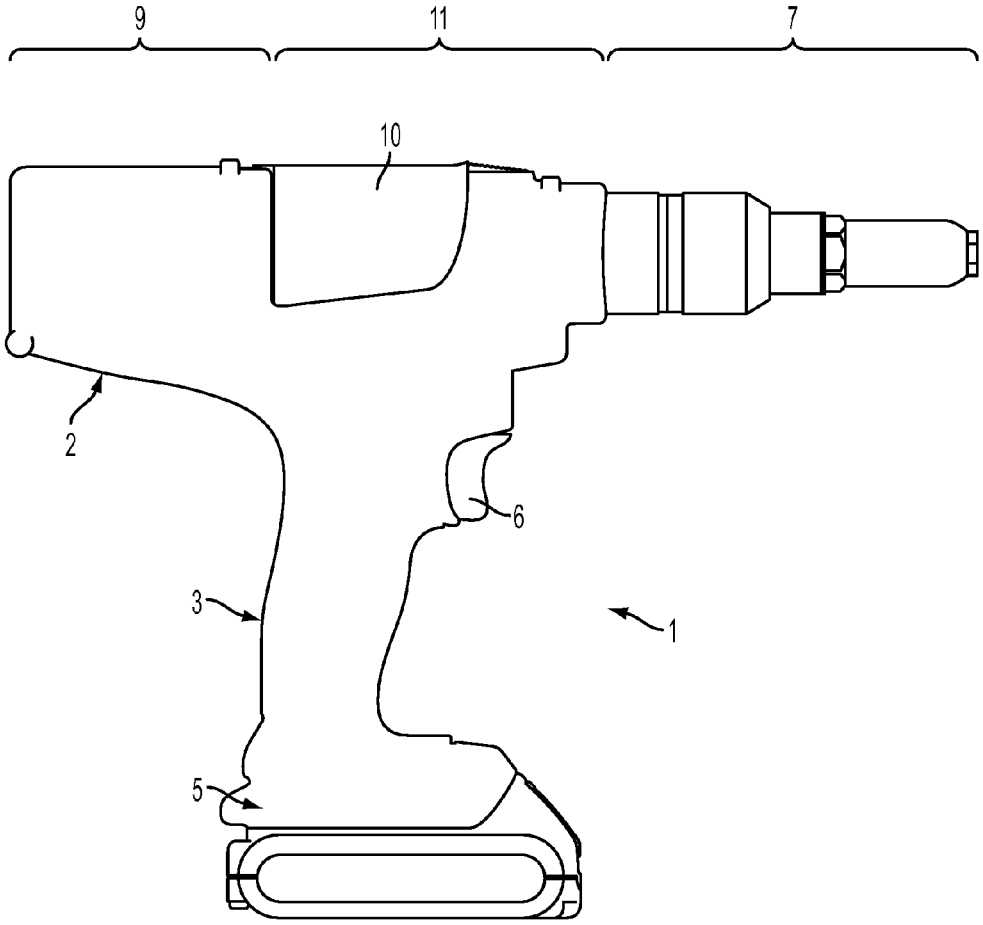
FIG. 1 A front view of an electric blind rivet fastening device according to a first embodiment.

The following is an explanation of the electric blind rivet fastening device in a first embodiment of the present invention with reference to the drawings. FIG. 1 is a front view of an electric blind rivet fastening device according to a first embodiment. The electric blind rivet fastening device 1 has a blind rivet fastening mechanism 2 housed inside a substantially cylindrical housing, and a handle 3 extending orthogonally down from the center position of the fastening mechanism 2. A battery is detachably mounted in a battery holder 5 in the lower portion of the handle 3. A trigger 6 is provided in the handle 3 at a position adjacent to the fastening mechanism 2. When the operator pulls the trigger 6, the fastening mechanism 2 is activated, and a blind rivet is fastened. When the trigger 6 is released, the fastening mechanism 2 returns to the home position HP (front end position) and the fastening operation is stopped (or completed).

The blind rivet fastening mechanism 2 has a nose 7 in the front (on the right in FIG. 1), a motor unit 9 in the rear (on the left in FIG. 1), and a power transmission controller 11 in the middle. A pulling head 30 (FIG. 3, etc.) is provided in the nose 7 to strongly pull the mandrel shaft of the blind rivet rearward (leftward in FIG. 1), and an electric motor 13 (brushless motor) is housed in the motor unit 9.

(Brushless Motor)

Figure 2:
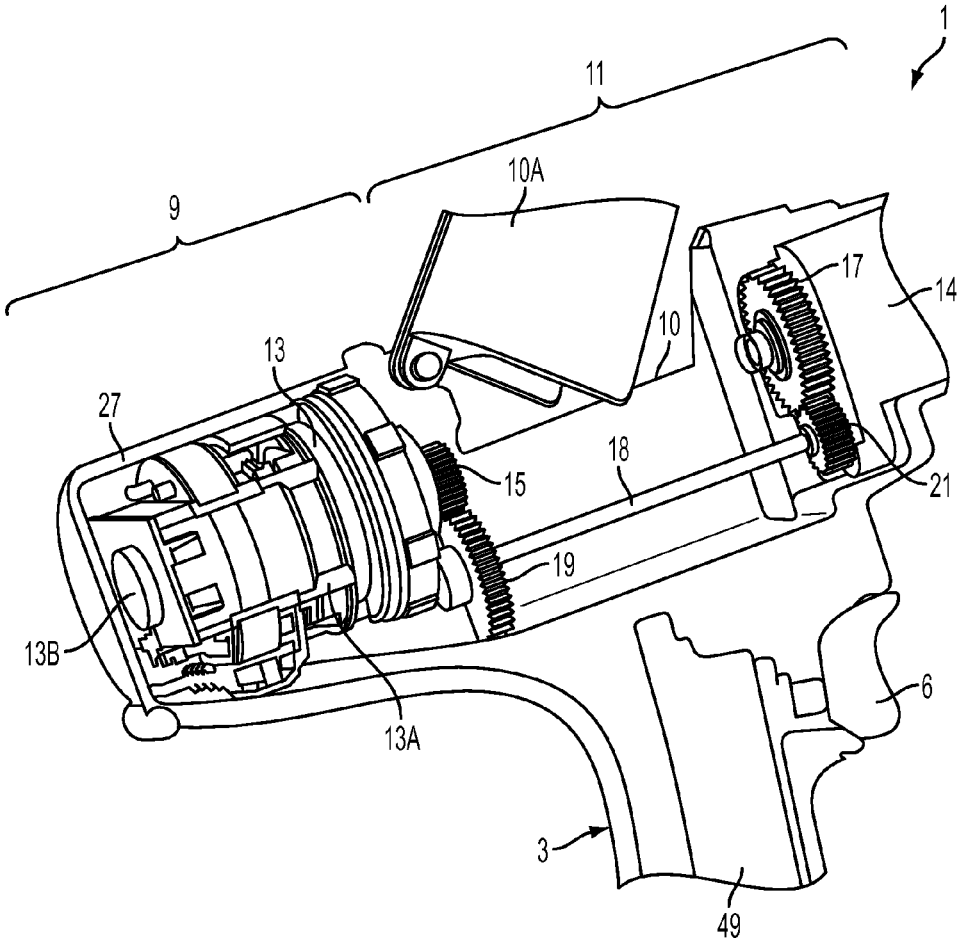
FIG. 2 A partial perspective view in which the rear portion of the fastening mechanism in the electric blind rivet fastening device of FIG. 1 has been cut away.

FIG. 2 shows the structure of the motor unit 9 and the power transmission controller 11 in the electric blind rivet fastening device 1 of the present invention. The motor unit 9 will be explained first. In the present invention, the electric motor 13 is a brushless motor. In the brushless motor, the rotor has magnets, and the windings are on the stator. A Hall element (magnetism sensor) 13A incorporated into the electric motor 13 detects the rotational angle of the rotor. An electronic circuit 13B for the brushless motor performs switching on timing based on the magnetic poles of the rotor. The brushless motor can determine the position of the pulling head by detecting the rotation of the rotor. Any commonly used element other than a Hall element can be used to detect the rotation of the rotor. Because brushless motors are well known, further explanation has been omitted.

(Collection Chamber)

A collection chamber 10 for broken mandrel shafts is provided in the upper portion of the handle 3 between the nose 7 and the motor unit 9. The collection chamber 10 has a semi-cylindrical shape, and is surrounded by a transparent or semi-transparent cover 10A. The broken mandrel shafts can be viewed through the cover 10A. The cover 10A can be opened and closed to remove the broken mandrel shafts.

A handle 3 extends downward at an angle from the location of the collection chamber 10 so that the blind rivet fastening device 1 is easier for the operator to grasp. Because the collection chamber 10 is arranged in the middle of the tool housing 27, a mandrel collector does not have to be placed at the rear end of the tool housing as in Patent Document 2, and handling of the fastening device by the operator is not destabilized by the weight of the electric motor as in Patent Document 1.

(Power Transmission Mechanism)

A power transmission controller 11 is provided between the motor unit 9 and the nose 7 below the collection chamber 10. The power transmission controller 11 has a power transmission mechanism for transmitting the rotational force (torque) of the electric motor 13 in the motor unit 9 to the spindle 14 in the nose 7, and a control mechanism for controlling the rotation of the electric motor 13 based on operation of the trigger, and for moving the pulling head of the nose 7 forward and backward via the rotation of the spindle 14. Because an electric blind rivet fastening device 1 fastens blind rivets using an electric motor 13 powered by a battery, a fluid supply tube (pressurized air, etc.) is not required, and the burden of moving a fluid supply tube is eliminated.

The power transmission controller 11 has a mechanism for transmitting rotational power from the electric motor 13 (brushless motor) in the motor unit 9 to the spindle 14 of the nose 7 while bypassing the space occupied by the collection chamber 10. A motor gear 15 is arranged to the rear of the collection chamber 10 and is connected to the motor shaft of the electric motor 13. A spindle gear 17 is arranged in front of the collection chamber 10 and is connected to the spindle 14 along a central axis coaxial with the central axis of the motor shaft.

A second shaft 18 is provided between the motor gear 15 and the spindle gear 17 in the space beneath the collection chamber 10. The second shaft 18 is supported in the longitudinal direction (axial direction) of the blind rivet fastening mechanism 2 and parallel to the central axis of the motor shaft of the electric motor 13 and the spindle 14 so as to rotate around the axis. A rear gear 19 engaging the motor gear 15 is provided on the rear end of the second shaft 18, and a front gear 21 engaging the spindle gear 17 is provided on the front end of the second shaft 18. The second shaft 18 is a single shaft that engages both the rear gear 19 and the front gear 21.

Because the rear gear 19 engages the motor gear 15, the second gear 18 rotates in the reverse direction when the electric motor 13 rotates in the forward direction. Because the front gear 21 engages the spindle gear 17, the spindle gear 17 rotates in the forward direction and the spindle 14 rotates in the forward direction when the second shaft 18 rotates in the reverse direction. In this way, the spindle 14 rotates in the same direction as the electric motor 13. The gear ratio of the motor gear 15 and the rear gear 19 and the gear ratio of the front gear 21 and the spindle gear 17 are determined by the output of the electric motor 13 and the fastening force for the blind rivets.

The power transmission controller 11 has a control mechanism for controlling the forward rotation, stopping, and reverse rotation of the electric motor 13 based on the operation of the trigger 6. In this way, the rotation of the electric motor 13 is transmitted to the spindle 14 via the second shaft 18. The control mechanism responds to the operation of the trigger 6 by controlling the electric motor 13, and drawing back the pulling head 30 of the nose 7 from the home position HP to the rear position RP where the mandrel shaft of the blind rivet is broken. It remains at the rear position RP until the trigger 6 is released. At this time, it moves forward from the rear position RP to the home position HP (front position). In this explanation, the home position HP and the rear position RP are positions in the axial direction of the pulling head 30. However, the home position HP and the rear position RP also correspond to the ball screw shaft 36, the jaw case 32, and the jaw 29.

(Blind Rivet)

Figure 3:
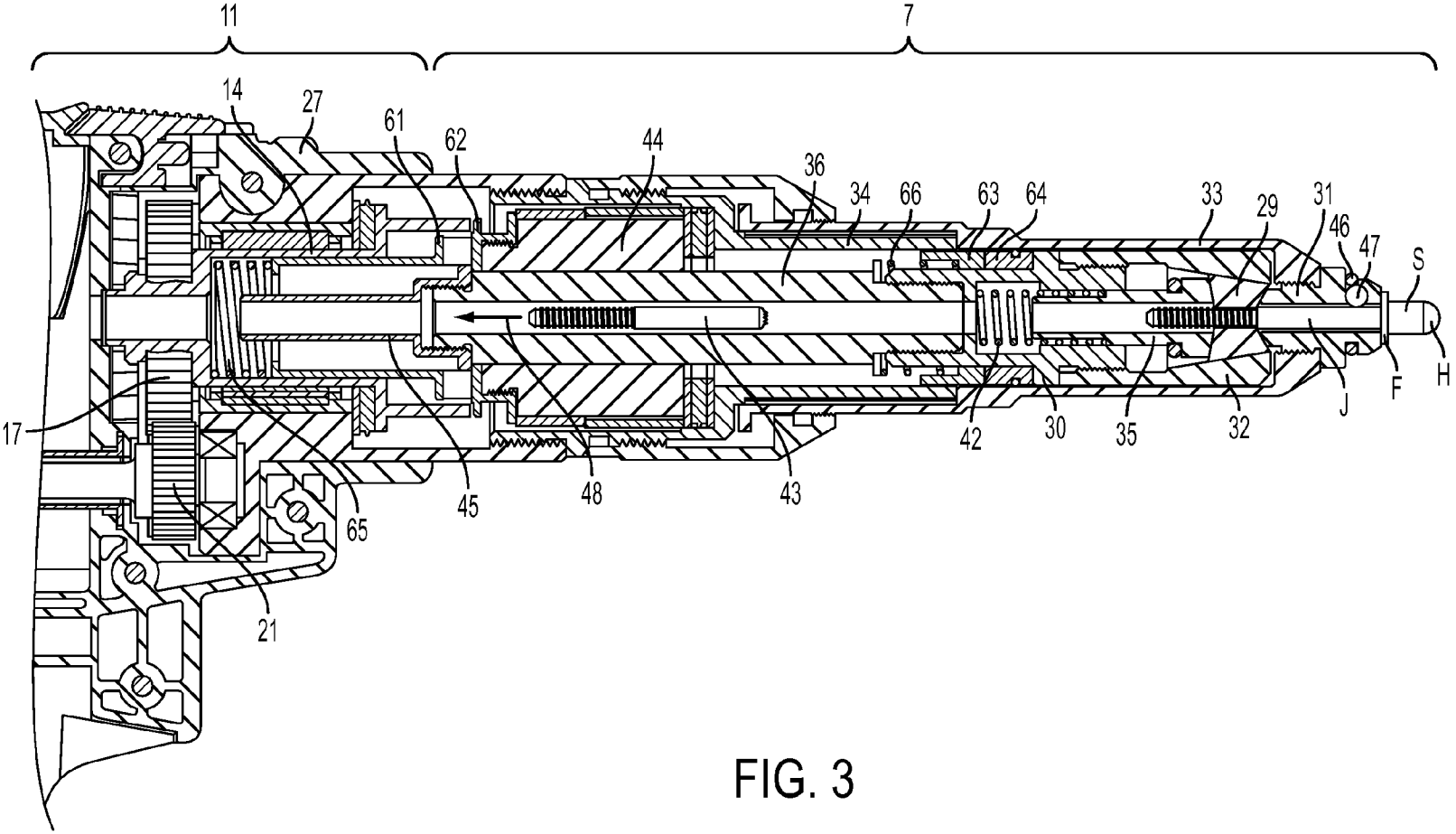
FIG. 3 A vertical cross-sectional view of the front portion of the fastening mechanism in the electric blind rivet fastening device of FIG. 1 in which a blind rivet has been attached to the nose.

FIG. 3 is a vertical cross-sectional view of the front portion of the fastening mechanism in the electric blind rivet fastening device of FIG. 1 in which a blind rivet has been attached to the nose 7. The blind rivet is held in the nose piece 31 of the electric blind rivet fastening device 1. The blind rivet has a rod-shaped mandrel M and a hollow, cylindrical rivet body R. The rivet body R has a cylindrical sleeve S, and a flange F with a diameter greater than that of the hollow sleeve formed at one end of the hollow sleeve. The mandrel M has a shaft J, which is a rod-shaped body extending from the flange through the rivet body where the portion passing through the flange of the rivet body R is gripped by the nose 7, and a mandrel head H with a diameter greater than the inner diameter of the hollow sleeve S which extends from the other end of the hollow sleeve. The blind rivet is held by the blind rivet fastening device with the gripped portion of the mandrel shaft J inserted into the nose 7 of the blind rivet fastening device, and the rivet body R and the mandrel head H protruding from the nose.

The blind rivet held by the blind rivet fastening device 1 is inserted into a mounting hole in fastened members such as an automotive body panel and automotive component until the sleeve S of the rivet head R comes into contact with a fastened member. Next, the mandrel shaft is strongly drawn back by the blind rivet fastening device 1, the mandrel head H deforms and widens a portion of the sleeve S of the rivet body R, and the fastened members are strongly interposed between the flange F and the deformed portion of the sleeve. When the fastened members, such as an automotive body panel and an automotive component, have been strongly interposed between the deformed sleeve and the flange F, the rivet R is fastened to the fastened members, and the automotive component is mounted on the automotive body panel. The blind rivet is usually made of a metal such as stainless steel or aluminum. When the blind rivet has been fastened, the broken mandrel shaft has to be collected.

(Nose)

Figure 4:
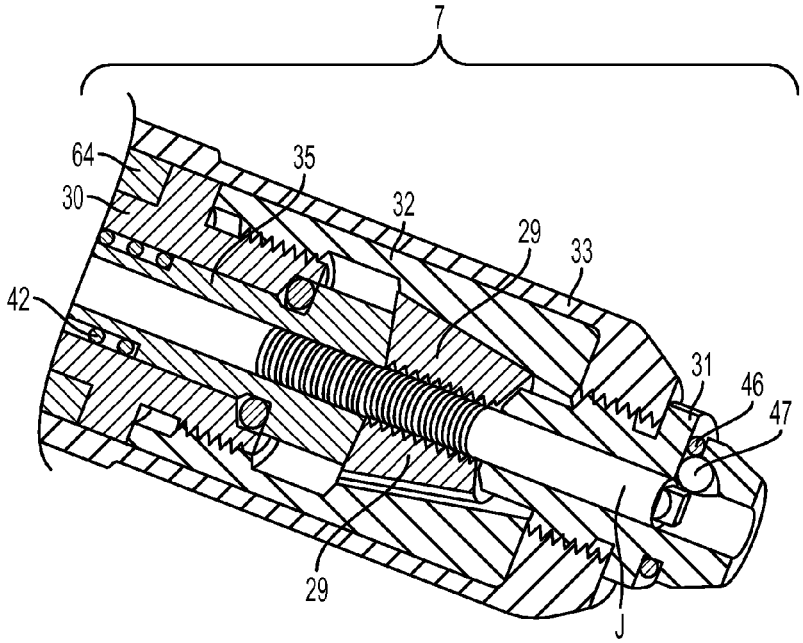
FIG. 4 A vertical cross-sectional view of the nose portion at the tip of the fastening mechanism of FIG. 3 in which the broken shaft portion of the mandrel of a blind rivet remains in the nose portion.

The following is an explanation with reference to FIG. 3 and FIG. 4 of the structure and operation of the blind rivet fastening mechanism 2 used to fasten blind rivets. The nose 7 occupies the front portion of the blind rivet fastening mechanism 2 in front of the collection chamber 10. As shown in FIG. 3, the nose 7 is hollow in the central axial portion. The mandrel M of the blind rivet is inserted and held in this portion. It also is able to send the broken mandrel shaft J to the collection chamber 10. The nose 7 includes a jaw 29 for gripping the mandrel shaft J, a jaw case 32 surrounding the jaw 29, and a pulling head 30 integrated with the jaw case 32 and able to move in the axial direction of the blind rivet fastening mechanism 2 so as to draw the jaw 29 to the rear.

The mandrel shaft J gripped by the jaw 29 is strongly pulled in a linear motion to the rear of the pulling head 30, the mandrel head H deforms and widens a portion of the sleeve S of the rivet body R, the fastened members are strongly interposed between the flange F and the deformed sleeve, the mandrel shaft J is broken off in the breakable portion, and the blind rivet is fastened in the fastened members.

FIG. 4 is a vertical cross-sectional view of the front portion of the nose 7 in the fastening mechanism of FIG. 3. Here, the mandrel shaft broken off the blind rivet is still in the nose portion. The nose 7 has a nosepiece 31 on the tip, and a cylindrical nose housing 33 extending from the nosepiece 31 towards the tool housing 27 in the rear. The cylindrical pulling head 30 is housed inside the nose housing 33 so as to be able to slide in the axial direction (longitudinal direction) with respect to the nose housing 33. The tip of the jaw 29 is arranged near the rear end of the nosepiece 31, and is housed inside the tapered cavity of the jaw case 32 which tapers towards the nosepiece 31.

When the jaw case 32 is drawn to the rear, the force is applied to the inclined surface of the tapered portion so concentrically with respect to the axis, and the gripping force on the shaft J of the mandrel M of the blind rivet held in the axial cavity of the jaw 29 is increased. The jaw 29 has two or three parts arranged concentrically inside the cylindrical jaw case 32, and combine to form a hollow cylinder with a cavity in the axial direction of the jaw case 32. This grips the mandrel M of the blind rivet inserted into the nosepiece 31 so that the shaft J of the mandrel M does not fall out.

A hollow, cylindrical jaw pusher 35 is arranged to the rear of the jaw 29 to apply forward pressure on the jaw 29. A jaw pusher spring 42 is arranged between the jaw pusher 35 and the pulling head 30, and applies forward pressure on the jaw pusher 35.

In the embodiment of the present invention, the pulling head 30 is integrated with the jaw case 32 surrounding and supporting the jaw 29. It is arranged along the central axis of the nose housing 33, and is able to slide in the axial direction with respect to the nose housing 33. The pulling head 30 can draw in the jaw 29 from the front end position to the rear end position, and return the jaw from the rear end position to the front end position.

An O-ring 46 and a steel ball 47 are provided to obstruct a portion of the hollow passage at the entrance to the nosepiece 31 to allow the mandrel M of a blind rivet to be inserted, but to keep the broken mandrel shaft 43 from being discharged from the nosepiece 31.

The pulling head 30 and the jaw case 32 can slide in the axial direction inside the nose housing 33. As explained below with reference to the second clutch, the pulling head 30 can rotate in the forward rotational direction of the spindle 14, and can rotate in the reverse direction when rotational force is applied in the reverse direction that exceeds a predetermined level.

Returning to FIG. 3, the pulling head 30 is fixed to the ball screw shaft 36 in the rear. The ball screw shaft 36 is a cylindrical member, and extends inside of the mast housing 34 fixed to the tool housing 27 in the axial direction. A cylindrical tail 45 narrower than the ball screw shaft 36 is connected to the rear of the ball screw shaft 36 in the axial direction. The tail 45 extends to the rear along the axial portion of the spindle 14. The tail 45, the ball screw shaft 36, and the pulling head 30 move linearly, and the jaw 29 is drawn backward and returned to the front of the nose 7.

The spindle 14 is connected to a ball screw nut 44 via a first clutch as explained below. A ball screw shaft 36 is arranged in the axial portion of the ball screw nut 44. Internal threading is formed in the ball screw nut 44. The external threading of the ball screw shaft 36 is screwed into this internal threading.

The rotation of the spindle 14 is transmitted to the ball screw nut 44. The forward rotation of the spindle 14 not moving in the axial direction is converted to retreating motion drawing the ball screw shaft 36 to the rear, and the reverse rotation of the spindle 14 is converted to advancing motion causing the ball screw shaft 36 to move forward. When the spindle 14 rotates in the forward direction, the ball screw shaft 36 and the pulling head 30 retreat, the mandrel shaft J of the blind rivet is gripped by the jaw 29 and strongly pulled, and the blind rivet is fastened.

As shown in FIG. 3, the axial portions of the jaw 29, the jaw pusher 35, the pulling head 30, the ball screw shaft 36, and the tail 45 form a hollow passage connecting the entrance of the nose 7 to the entrance of the collection chamber 10. In this way, the shaft of the mandrel M is inserted into the jaw 29, and the broken mandrel shaft 43 is sent to the collection chamber 10 along arrow 48 in FIG. 3. A broken mandrel shaft is pushed through the hollow passage by the next broken mandrel shaft.

(Clutches)

Figure 5:
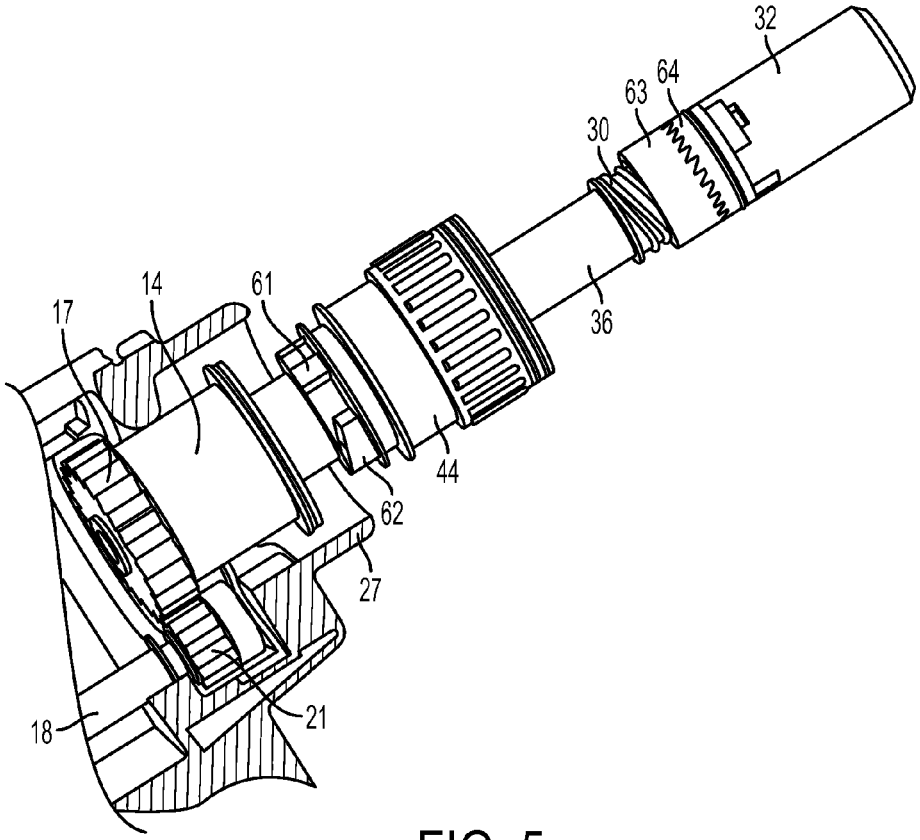
FIG. 5 A perspective view in which some of the nose portion of the electric blind rivet fastening mechanism of FIG. 1 has been removed.

In the embodiment of the present invention, the pulling head 30 moves between a home position HP at the front end and a rear position RP where the mandrel is broken. However, clutches are provided to keep excessive torque from moving the pulling head 30 beyond the range defined by the home position HP and the rear position RP. FIG. 5 is a perspective view of a portion of the nose 7 in which the mast housing 34 and nose housing 33 have been removed to show the internal structure.

A first clutch consisting of a spindle clutch 61 and a nut clutch 62 is provided in the portion between the spindle 14 and the ball screw nut 44. When the pulling head 30 is pulled back to the rear position RP, the spindle clutch 61 and the nut clutch 62 in the first clutch disengage, and rotation is not transmitted from the spindle 14 to the ball screw nut 44. This keeps the pulling head 30 from being pulled back too far. A second clutch is provided in front of the ball screw shaft 36, which consists of a rear clutch 63 and a front clutch 64. In the second clutch, when the pulling head 30 reaches the home position HP at the front end, the front clutch 64 and the pulling head 30 are allowed to rotate with the ball screw nut 44, and this prevents the application of excessive torque to the pulling head 30.

(1st Clutch)

Figure 6:
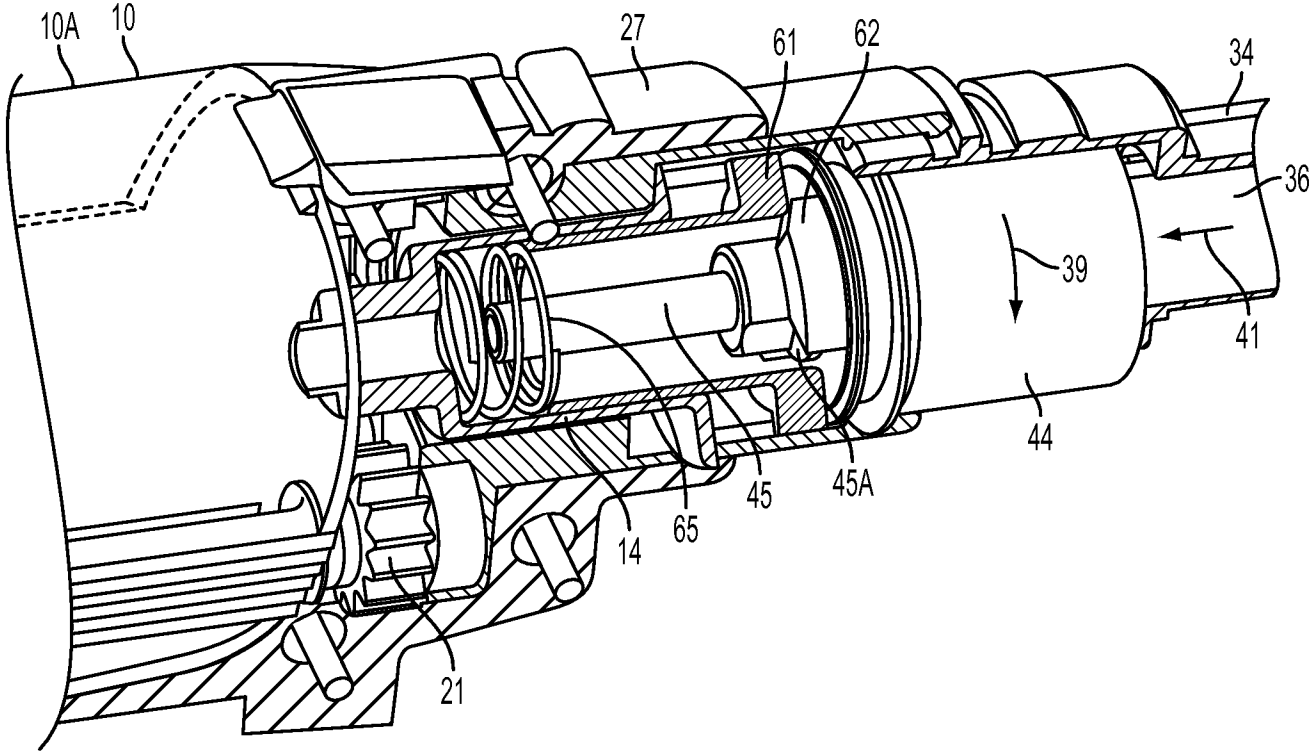
FIG. 6 A perspective view in which a portion of the first clutch has been removed.

FIG. 6 is a perspective view of a portion of the first clutch consisting of the spindle clutch 61 and the nut clutch 62 in which the tool housing 27 and mast housing 34 have been removed to show the internal structure. The spindle clutch 61 is provided near the inside of the cylindrical spindle 14. The spindle clutch 61 cannot rotate with respect to the spindle 14, but can slide in the axial direction and is pushed in the direction of the nut clutch 62 by the spindle clutch spring 65. The spindle clutch 61 has a cylindrical portion, and a flange portion at the end of the cylindrical portion. The flange portion has a fan-shaped portion as viewed in the axial direction.

The nut clutch 62 is integrated with the ball screw nut 44. The nut clutch 62 has a fan-shaped portion, which is inserted into the non-fan-shaped portion of the spindle clutch 61. In other words, the fan-shaped portion of the spindle clutch 61 is complemented by the fan-shaped portion of the nut clutch 62. When the pulling head 30 has moved to a position in front of the rear position RP, the fan-shaped portion of the spindle clutch 61 engages the fan-shaped portion of the nut clutch 62, and the rotation of the spindle clutch 61 is transmitted to the nut clutch 62.

The tail 45 is connected to the rear end of the ball screw shaft 36. A tail protrusion 45A is provided in the axial portion of the tail 45. When the pulling head 30 moves to the rear, the tail 45 also moves to the rear. When the tail protrusion 45A has moved through the inside of the spindle clutch 61 and has reached the end face inside the spindle clutch 61, the end face is pushed, the spindle clutch 61 resists the action of the spindle clutch spring 65 and moves to the rear (in the direction of arrow 41). As a result, the spindle clutch 61 and the nut clutch 62 disengage.

When the trigger 6 is squeezed with the pulling head 30 in the home position HP, the electric motor 13 rotates in the forward direction (the direction indicated by arrow 39). The rotation of the electric motor 13 is transmitted to the spindle 14 and from the spindle clutch 61 integrated with the spindle 14 to the nut clutch 62 in order to rotate the ball screw nut 44 integrated with the nut clutch 62 and rotate the ball screw shaft 36 in the direction of arrow 41 (the rear direction).

When the pulling head 30 has reached the rear position RP, the tail protrusion 45A of the tail 45 integrated with the ball screw shaft 36 makes contact with the inner end face of the spindle clutch 61. The spindle clutch 61 is pushed by the tail protrusion 45A against the action of the spindle clutch spring 65 in the direction of arrow 41. This causes the spindle clutch 61 and the nut clutch 62 to disengage. As a result, the nut clutch 62 no longer rotates with the ball screw nut 44 and the spindle clutch 61. Movement of the ball screw shaft 36 in the direction of arrow 41 is stopped, and the drawing action of the pulling head 30 is stopped.

If, for whatever reason, the pulling head 30 has retreated beyond the predetermined rear position RP and the forward rotation of the spindle 14 is stopped, the spindle clutch 61 and the nut clutch 62 disengage at the rear position RP, stopping the transmission of rotation from the spindle clutch 61 to the nut clutch 62, and keeping the pulling head 30 from being drawn back too far.

(2nd Clutch)

Figure 7A:
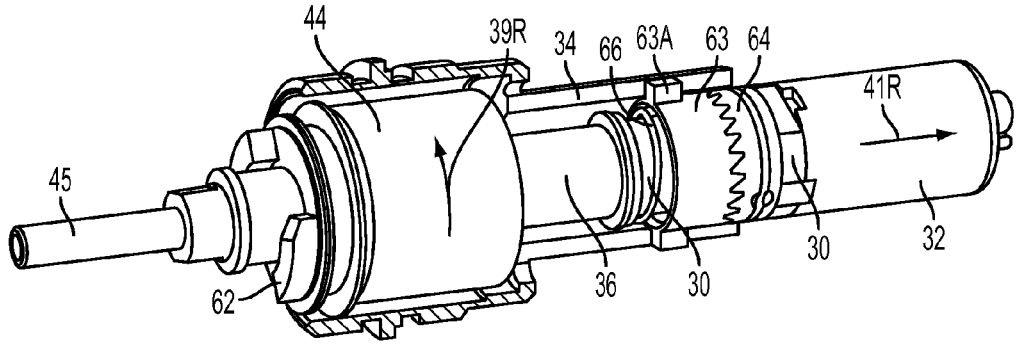
FIG. 7A A perspective view in which a portion of the second clutch has been removed.
Figure 7B:
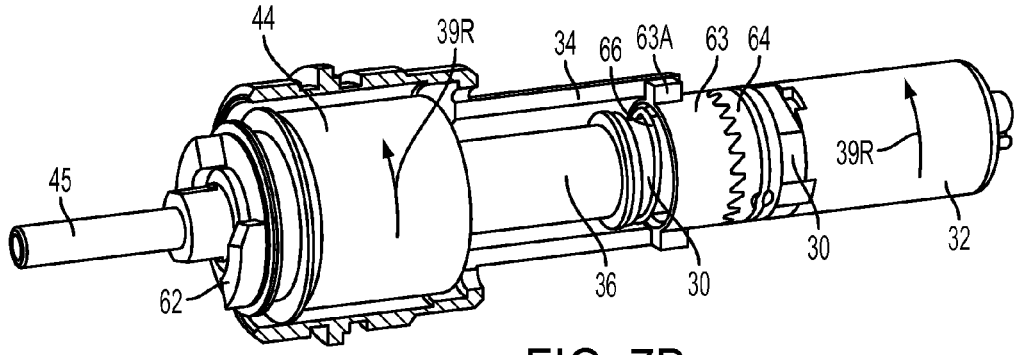
FIG. 7B A perspective view in which a portion of the second clutch has been removed.
Figure 7C:
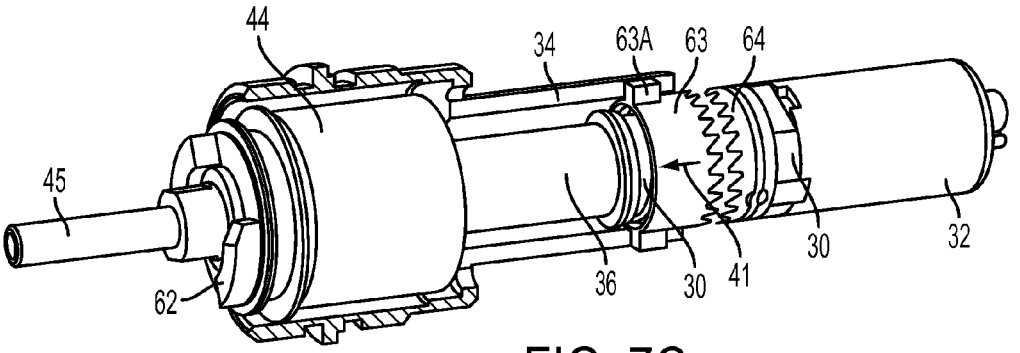
FIG. 7C A perspective view in which a portion of the second clutch has been removed.

FIG. 7A through FIG. 7C are perspective views of a portion of the second clutch consisting of a rear clutch 63 and a front clutch 64. The nose housing 33 and a portion of the mast housing 34 have been removed to show the internal structure. FIG. 7A shows the pulling head 30 at the rear position RP before it has returned to the home position HP. FIG. 7B shows the pulling head 30 at the home position HP, and the ball screw shaft 36 at the front end. FIG. 7C shows the front clutch 64 and the rear clutch 63 disengaged at the home position HP so that the pulling head 30 can no longer move.

Referring to FIG. 7A, when the ball screw shaft 36 is to the rear of the front end, the end face of the tail 45 does not come into contact the nut clutch 62. When the ball screw nut 44 is rotated, the ball screw shaft 36 moves in the axial direction. When the ball screw shaft 36 has reached the front end, the end face of the tail 45 comes into contact with the nut clutch 62, and the ball screw shaft 36 does not move any further towards the front. Because the external threading of the ball screw shaft 36 engages the internal threading of the ball screw nut 44, the ball screw shaft 36 rotates with the ball screw nut 44.

Rear clutch 63 is a cylindrical member surrounding the pulling head 30 It is arranged so as to be able to move a predetermined distance around the pulling head 30 in the axial direction. Saw teeth are provided at the front end of the rear clutch 63. One face of the saw teeth is parallel to the axial direction, and the other face is on an incline. A rear clutch protrusion 63A is provided on the outer peripheral portion of the rear clutch 63 to make contact with the mast housing 34 and stop the rotation. The rear clutch 63 is pushed against the front clutch 64 by the rear clutch spring 66.

A cylindrical front clutch 64 is provided around the pulling head 30 in front of the rear clutch 63. The front clutch 64 is connected so as to rotate with the pulling head 30. The front clutch 64 has saw teeth in the rear facing the rear clutch 63. One face of the saw teeth in the front clutch 64 is parallel to the axial direction, and the other face is on an incline to engage the saw teeth of the rear clutch 63.

When the front clutch 64 rotates in the forward direction opposite arrow 39R, the saw teeth of the rear clutch 63 and the saw teeth of the front clutch 64 mesh on the face in the axial direction of the saw teeth. This prevents slipping. Because rotation of the rear clutch 63 is stopped by the rear clutch protrusion 63A, the front clutch 64 and the pulling head 30 cannot rotate. Therefore, when the spindle 14 rotates in the forward direction and the pulling head 30 has moved to the rear in the fastening operation, the rotation of the pulling head 30 is stopped.

When the front clutch 64 rotates in the reverse direction indicated by arrow 39R, the saw teeth of the rear clutch 63 and the saw teeth of the front clutch 64 mesh on the inclined face of the saw teeth. As a result, slippage occurs when the rotational force exceeds a predetermined level. The rear clutch 63 resists the action of the rear clutch spring 66, and slides in the rear direction indicated by arrow 41. As a result, the rotation of the front clutch 64 in the rear direction is not transmitted to the rear clutch 63, and the front clutch 64 and the pulling head 30 rotate. Therefore, when the spindle 14 does not stop rotating when the pulling head 30 has returned to the home position HP, the pulling head 30 and the front clutch 64 rotate in the reverse direction indicated by arrow 39R along with the spindle 14, the rear clutch 63 retreats and disengages from the front clutch 64, and the front clutch 64 is allowed to rotate.

As shown in FIG. 7A, when the trigger 6 is release with the pulling head 30 in the rear position RP, the electric motor 13 rotates in the reverse direction indicated by arrow 39R, the rotation of the motor 13 is transmitted from the spindle clutch 61 to the nut clutch 62, the ball screw nut 44 integrated with the nut clutch 62 rotates in the reverse direction indicated by arrow 39R, and the rear clutch 63 and the front clutch 64 engage to move the ball screw nut 36, which is unable to rotate, in the direction of arrow 41R (forward direction). The tail 45 does not come into contact with the nut clutch 62.

Referring to FIG. 7B, when the pulling head 30 has returned to the home position HP and the ball screw shaft 36 has reached the front end, the end face of the tail 45 comes into contact with the nut clutch 62. The ball screw shaft 36 does not move any further in the direction indicated by arrow 41R. Instead, the ball screw shaft 36 begins to rotate with the ball screw nut 44. The rotation of the ball screw shaft 36 is transmitted to the front clutch 64 via the pulling head 30.

Referring to FIG. 7C, the rear clutch protrusion 63A makes contact with the mast housing 34, and the rear clutch 63 no longer rotates. When the front clutch 64 begins to rotate, the rear clutch 63 cannot be rotated by the mast housing 34 but instead moves in the direction of arrow 41 (the rear direction) against the action of the rear clutch spring 66, and the front clutch 64 and the rear clutch 63 disengage. The pulling head 30, the jaw case 32, and the front clutch 64 rotate but do not move forward.

If, for some reason, the spindle 14 does not stop rotating in the reverse direction when the pulling head 30 has returned to the home position HP, the pulling head 30, the jaw case 32, and the front clutch 64 rotate, and the rear clutch 63 moves to the rear. Because the front clutch 64 does not obstruct the rotation of the rear clutch 63, the ball screw shaft 36 is allowed to rotate, and the pulling head 30 can be kept from moving forward beyond the home position HP.

(Operation Control for Fastening Device)

By pulling and releasing the trigger 6, the power transmission controller 11 rotates the electric motor 13 in the forward direction, stops the motor, and rotates the motor in the reverse direction. When the motor shaft of the electric motor 13 rotates, the motor gear 15 and the rear gear 19 rotate the second shaft 18. When the second shaft 18 rotates, the front gear 21 and the spindle gear 17 rotate the spindle 14. The ball screw nut 44 rotates, and the ball screw shaft 36 moves in the axial direction. The pulling head 30 is drawn backward or returns forward.

Figure 8:
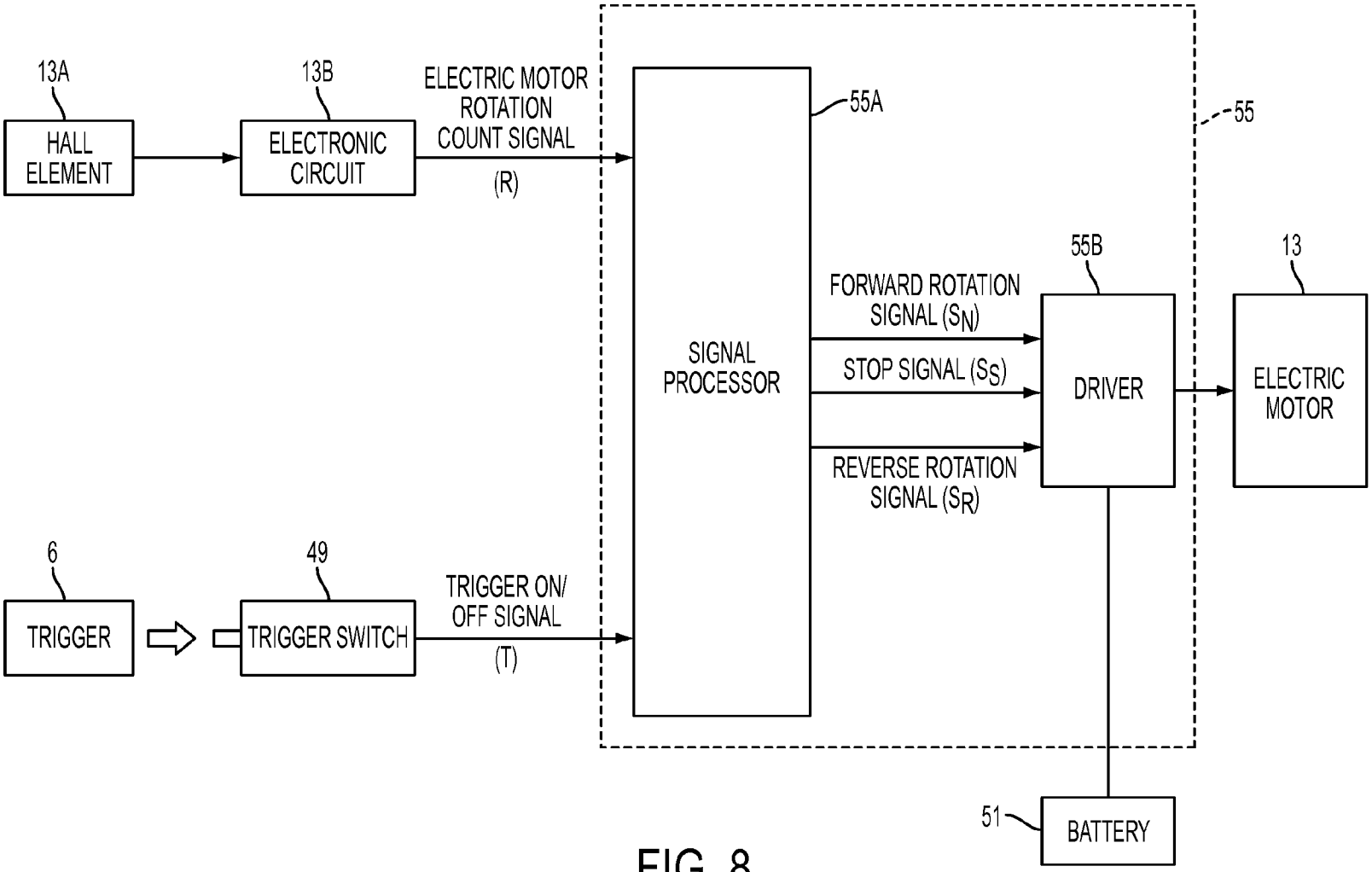
FIG. 8 A block diagram of the power transmission controller of the electric blind rivet fastening device in FIG. 1.

FIG. 8 is a block diagram of the power transmission controller. In response to ON/OFF signals outputted by the trigger switch 49 when the trigger 6 is squeezed or released, the control circuit 55 shown in FIG. 8 controls the electric motor 13, the pulling head 30 in the nose 7 retreats from the home position HP at the front of the blind rivet fastening mechanism 2 to the rear position RP where the mandrel shaft of the blind rivet is broken. The head stops at the rear position RP, and then advances from the rear position RP to the home position HP at the front end.

The following is an explanation of how the electric motor 13, the spindle 14, the pulling head 30, the jaw 29 and other components are controlled by the control means based on the operation of the trigger 6 and detection of the rotation count of the electric motor 13. The rotation count of the electric motor 13 is detected by the Hall element 13A, and rotation count signals (R) regarding the electric motor 13 are outputted by the electronic circuit 13B to the control circuit 55 serving as the control means. ON/OFF signals from the trigger switch 49 turned ON and OFF by squeezing and releasing the trigger 6 are inputted to the control circuit 55. A signal processor 55A is provided in the control circuit 55. The signal processor 55A receives the rotation count signals (R) from the electric motor 13 and ON/OFF signals (T) from the trigger switch 49, and outputs forward rotation signals ($S_N$), stop signals ($S_S$) and reverse rotation signals ($S_R$). These signals cause the electric motor 13 to rotate in the forward direction, stop, or rotate in the reverse direction.

A driver 55B is also provided in the control circuit 55. The driver 55B receives forward rotation signals ($S_N$), stop signals ($S_S$) and reverse rotation signals ($S_R$) from the signal processor 55A, and controls the supply of power from the battery 51 to the electric motor 13 to rotate the motor in the forward direction, stop the motor, or rotate the motor in the reverse direction. The signal processor 55A and driver 55B constituting the control circuit 55 are arranged inside the handle 3.

Because power is supplied from the battery 51 to the electric motor 13, the pulling head 30 is positioned at the home position HP in the front of the blind rivet fastening mechanism 2 (the position in FIG. 3). When the pulling head 30 is at the home position HP, the rotation count of the electric motor 13 is reduced to zero. When the rotation count of the electric motor 13 is zero while an ON signal is not being outputted (or OFF signal is being outputted) from the trigger switch 49 of the trigger 6, the pulling head 30 is at the home position HP. The electric motor 13 stops operating and the pulling head 30 is at the home position HP even when power is being supplied from the battery 51 to the electric motor 13 as long as the trigger 6 is not activated. An OFF signal ($T_{OFF}$) from the trigger switch 49 of the trigger 6 and a rotation count of zero from the electric motor 13 indicate to the control circuit that the fastening device 1 is at the home position HP, and a stop signal ($S_S$) is outputted.

When the trigger 6 is squeezed while the rotation count of the electric motor 13 is at zero, an ON signal ($T_{ON}$) is outputted from the trigger switch 49, and the signal processor 55A in the control circuit 55 provided in the electric blind rivet fastening device 1 outputs a forward rotation signal ($S_N$) to rotate the electric motor 13 in the forward direction. Receiving the forward rotation signal ($S_N$), the driver 55B sends power from the battery 51 to the electric motor 13, and the electric motor 13 is rotated in the forward direction.

When the electric motor 13 rotates in the forward direction, the rotation is transmitted to the spindle 14 via the motor gear 15, the rear gear 19, the second shaft 18, the front gear 21 and the spindle gear 17, and the spindle 14 rotates in the forward direction. The forward rotation of the spindle 14 causes the ball screw shaft 36 (FIG. 3) to retreat in the axial direction, and the pulling head 30 to retreat in the axial direction a predetermined length from the home position HP at the front end (the length required to break the mandrel shaft). This retreating action causes the jaw 29 to retreat from the front position, and for the shaft J of the mandrel M of the blind rivet gripped in the jaw 29 to be drawn back.

The drawing back action causes the mandrel shaft J to break, the mandrel head H to deform and widen a portion of the sleeve S of the rivet body R, and the fastened members to be strongly interposed between the flange F of the rivet body R and the deformed portion of the sleeve. When a plurality of fastened members such as an automotive body panel and automotive component have been strongly interposed between the deformed sleeve and the flange F, the rivet body R is fastened to the fastened members, and the automotive component is mounted on the automotive body panel.

When the electric motor 13 rotates in the forward direction, the motor gear 15 and the rear gear 19 cause the second shaft 18 to rotate in the reverse direction. When the second shaft 18 rotates in the reverse direction, the spindle 14 rotates in the forward direction, and the pulling head 30 moves in the axial direction. The position of the pulling head 30 in the axial direction is determined by the rotation count of the electric motor 13 detected by the Hall element 13A. When the electric motor 13 is rotating at a predetermined count (the rotation count corresponding to the length moved by the pulling head 30 to break the mandrel shaft) and the pulling head 30 has moved past the position where the mandrel shaft J is broken to the rear position RP, the rotation count signals from the electronic circuit 13B is used to determine the rotation count of the brushless motor 13. Because the trigger 6 is being operated, an ON signal ($T_{ON}$) is outputted from the trigger switch 49.

When the electric motor 13 reaches a predetermined rotation count while an ON signal ($T_{ON}$) is being outputted from the trigger switch 49, the pulling head 30 is in the rear position RP. The signal processor 55A of the control circuit 55 receives an ON signal ($T_{ON}$) from the trigger switch 49 and the predetermined rotation count from the electric motor 13, and outputs a stop signal. The driver 55B receives the stop signal ($S_S$) to stop the rotation of the electric motor 13 (stopping the motor using braking or regenerative braking). When the electric motor 13 is stopped, the rotation of the spindle 14 stops, and the pulling head 30 (jaw 29) stops at the rear position RP.

When the trigger 6 is squeezed while rotation of the electric motor 13 has stopped and the pulling head 30 is in the rear position RP (that is, an ON signal ($T_{ON}$) has been outputted from the trigger switch 49 of the trigger 6 and the electric motor 13 has reached the predetermined count), the ON signal ($T_{ON}$) from the trigger switch 49 of the trigger 6 is eliminated (or an OFF signal is outputted). The signal processor 55A in the control circuit 55 receives an OFF signal ($T_{OFF}$) from the trigger switch 49, the predetermined count is received from the electric motor 13, and a reverse rotation signal ($S_R$) is outputted. The driver 55B receives the reverse rotation signal ($S_R$) and rotates the electric motor 13 in the reverse direction. When the electric motor 13 rotates in the reverse direction, the spindle 14 also rotates in the reverse direction, the ball screw shaft 6 moves forward, and the pulling head 30 moves from the rear position RP to the home position HP at the front end.

When the pulling head 30 has returned to the home position HP, the rotation count of the electric motor 13 is reduced to zero. The control circuit 55 receives an OFF signal ($T_{OFF}$) from the trigger switch 49 and a zero rotation count signal from the electric motor 13, and outputs a stop signal ($S_S$). When the pulling head 30 is at the home position HP, the control circuit 55 deactivates the electric motor 13 unless the trigger 6 has been pulled. Thus, the electric motor 13 stops operating, and the pulling head 30 remains in the home position HP.

When the trigger 6 is released while the electric motor 13 is rotating in the forward direction and the electric motor 13 has not yet reached a predetermined rotation count, the signal processor 55A in the control circuit 55 receives a rotation count signal (R) from the electric motor 13 and an OFF signal ($T_{OFF}$) from the trigger switch 49, and sends a reverse rotation signal ($S_R$) to the driver 55B. The driver 55B then rotates the electric motor 13 in the reverse direction. The reverse rotation of the electric motor 13 continues until the rotation count of the electric motor 13 reaches zero and the pulling head 30 (jaw 29) has been returned to the home position HP at the front end of the blind rivet fastening mechanism 2. In this way, the pulling head 30 can be returned to the home position HP even if, for some reason, the blind rivet fastening operation has been suspended. Therefore, when the blind rivet fastening operation is ended prematurely, the blind rivet fastening operation can be suspended by simply releasing the trigger 6.

If, for some reason, the forward rotation of the spindle 14 does not stop even when the pulling head 30 has retreated to a predetermined rear position RP, the first clutch can be released and the rear position RP to keep the pulling head 30 from being drawn back too far. If, for some reason, the spindle 14 does not stop rotating in the reverse direction when the pulling head 30 has returned to the home position HP and excessive torque is applied, the second clutch slips, the pulling head 30 rotates with the spindle 14 in the reverse direction, and the pulling head 30 is kept from extending forward from the home position HP. If, for some reason, the pulling head 30 is about to advance beyond the home position HP, the spindle 14 continues rotating in the reverse direction and the pulling head 30 is kept from advancing beyond the home position HP. Here, the second clutch slips at the home position HP, and the pulling head 30 is positioned at the home position HP.

The embodiment of the present invention is able to increase the capacity of the collection chamber for collecting broken mandrels, It is also able to avoid excessive force due to an over stroke.

KEY TO TEXT IN FIGURES

Reference numbers appearing in the Figures are discussed in the written description herein.

1: Electric blind rivet fastening device
2: Blind rivet fastening mechanism
3: Handle
5: Battery holder
6: Trigger
7: Nose
9: Motor unit
10: Collection chamber
10A: Cover
11: Power transmission controller
13: Electric motor
13A: Hall element
13B: Electronic circuit
14: Spindle
15: Motor gear
17: Spindle gear
18: Second shaft
19: Rear gear
21: Front gear
27: Tool housing
29: Jaw
30: Pulling head
31: Nosepiece
32: Jaw case
33: Nose housing
34: Mast housing
35: Jaw pusher
36: Ball screw shaft
39: Arrow
41: Arrow
42: Jaw pusher spring
43: Broken mandrel shaft
44: Ball screw nut
45: Tail
46: O-ring
47: Steel ball
48: Arrow
49: Trigger switch
51: Battery
55: Control circuit
55A: Signal processor
55B: Driver
61: Spindle clutch
62: Nut clutch
63: Rear clutch
63A: Rear clutch protrusion
64: Front clutch
65: Spindle clutch spring
66: Rear clutch spring
F: Flange
H: Mandrel head
J: Shaft
M: Mandrel
R: Rivet body
S: Cylindrical sleeve

The invention claimed is:

1. A blind rivet fastening device for deforming a sleeve of a rivet body so as to expand diametrically by drawing, in the axial direction, a mandrel of a blind rivet including a mandrel and a rivet body, thereby fastening the rivet body to a mounted member via the expanded sleeve portion and a flange of the rivet body, and breaking the mandrel, the blind rivet fastening device characterized in comprising:

an electric motor provided on one end;

a power transmitting means for transmitting the rotation of the electric motor;

a spindle provided in front of the electric motor and rotated by the power transmitted by the power transmitting means;

a ball screw nut adjacent to the spindle, and connected to and rotated by the spindle;

a ball screw shaft provided in the central portion of the ball screw nut in the axial direction, and moved in the axial direction by the rotation of the ball screw nut;

a drawing means connected to the ball screw shaft for gripping and drawing a shaft portion of the mandrel;

a rotation count detecting element for detecting the rotation count of the electric motor;

a trigger provided in a handle portion; and a control means for controlling the forward rotation, reverse rotation, and stopping of the electric motor based on operation of the trigger and the rotation count of the electric motor;

a first clutch including a spindle clutch and a nut clutch, the first clutch positioned between the spindle and the ball screw nut, and a second clutch which includes a rear clutch and a front clutch is positioned in front of the ball screw shaft, wherein the first and second clutches are provided to keep excessive tongue from moving the pulling head beyond the range defined by the home position HP and the rear position RP.

2. An electric blind rivet fastening device according to claim 1, wherein a collection chamber for collecting the broken portions of mandrel shafts is provided between the electric motor and the spindle.

3. An electric blind rivet fastening device according to claim 1, wherein the drawing means comprises:

a pulling head moved in the axial direction by the ball screw shaft moving in the axial direction;

a jaw case adjacent to the pulling head, integrated with the pulling head, and having an inner peripheral surface whose inner diameter becomes smaller towards the front end;

a jaw provided inside the jaw case, and having an outer peripheral surface in contact with the inner peripheral surface of the jaw case; and a nose piece adjacent to the jaw, and having an opening portion through which passes the shaft portion of the mandrel.

4. An electric blind rivet fastening device according to claim 1, wherein the power transmitting means comprises:

a motor gear connected to the electric motor; a rear gear provided below the motor gear and engaging the motor gear; a spindle gear engaging the spindle; a front gear provided below the spindle gear and engaging the spindle gear; a second shaft provided below the collection chamber and integrally joined to the rear gear and the front gear.

5. An electric blind rivet fastening device according to claim 1, wherein the electric motor is a brushless motor.

6. An electric blind rivet fastening device according to claim 1, wherein the rotation count detecting element is a Hall element.

7. An electric blind rivet fastening device according to claim 1, wherein the spindle clutch includes a cylindrical portion and a fan-shaped portion, able to move in the axial direction with respect to the spindle, and rotating with the spindle; and wherein the nut clutch includes a fan-shaped portion engaging the fan-shaped portion of the spindle clutch, and integrally joined to the ball screw nut;

the first clutch able to disengage from the spindle clutch and the nut clutch so as not to transmit the rotation of the spindle to the ball screw nut.

8. An electric blind rivet fastening device according to claim 7, wherein a protruding portion of a cylindrical tail integrally joined to the rear end of the ball screw shaft pushes an inner end face of the spindle clutch to the rear in the axial direction, and the fan-shaped portion of the spindle clutch disengages the fan-shaped portion of the nut clutch when the ball screw shaft reaches the rear end in the axial direction.

9. An electric blind rivet fastening device according to claim 3, further comprising a second clutch including:

a rear clutch having a cylindrical shape and saw teeth at the front end, and arranged so as to be able to move in the axial direction around the pulling head but so as not to be able to rotate; and a front clutch having a cylindrical shape and saw teeth at the rear end engaging the saw teeth of the rear clutch, and arranged in front of the rear clutch, around the pulling head, and integrally joined to the pulling head.

10. An electric blind rivet fastening device according to claim 9, wherein the saw teeth of the rear clutch have one face which is parallel to the rear clutch in the axial direction, and another face inclined with respect to the axial direction; and the saw teeth of the front clutch have a shape able to engage the saw teeth of the rear clutch.

11. An electric blind rivet fastening device according to claim 10, wherein the ball screw shaft does not move in the axial direction but rotates with the ball screw nut, the front clutch rotates, and the rear clutch retreats in the axial direction so the front clutch is able to rotate when the ball screw shaft reaches the front end.

* * * * *